US008857000B2

(12) United States Patent
Patamia

(10) Patent No.: US 8,857,000 B2
(45) Date of Patent: Oct. 14, 2014

(54) DRY BOARD ERASER SYSTEM

(76) Inventor: Stefano Patamia, Netcong, NJ (US)

( * ) Notice: Subject to any disclaimer, the term of this patent is extended or adjusted under 35 U.S.C. 154(b) by 266 days.

(21) Appl. No.: 13/528,119

(22) Filed: Jun. 20, 2012

(65) Prior Publication Data

US 2013/0000063 A1 Jan. 3, 2013

Related U.S. Application Data

(60) Provisional application No. 61/502,079, filed on Jun. 28, 2011.

(51) Int. Cl.

| | |
|---|---|
| ***B43L 21/00*** | (2006.01) |
| ***B43L 19/00*** | (2006.01) |
| ***B43K 23/00*** | (2006.01) |
| ***B08B 1/00*** | (2006.01) |
| ***B43L 19/04*** | (2006.01) |
| ***B43L 1/00*** | (2006.01) |

(52) U.S. Cl.

CPC ..... *B43K 23/001* (2013.01); *B43L 19/00* (2013.01); *B43L 19/0056* (2013.01); *B08B 1/008* (2013.01); *B43L 19/0006* (2013.01); *B43L 19/04* (2013.01); *B43L 1/00* (2013.01)

USPC ..... 15/98; 15/97.1; 15/246

(58) Field of Classification Search

USPC ..... 15/102, 98, 103, 103.5, 425, 246, 97.1; 434/411, 408, 417

See application file for complete search history.

(56) References Cited

U.S. PATENT DOCUMENTS

| | | | | |
|---|---|---|---|---|
| 4,288,936 | A | 9/1981 | Okutsu | |
| 5,186,631 | A * | 2/1993 | Okutsu | 434/409 |
| 5,649,828 | A * | 7/1997 | Kawashima | 434/411 |
| 5,820,385 | A | 10/1998 | Ohashi | |
| 6,073,297 | A * | 6/2000 | Lee | 15/102 |
| 7,431,590 | B2 * | 10/2008 | Gerhardt | 434/408 |
| 8,191,197 | B1 * | 6/2012 | Hunsucker | 15/246 |
| 2008/0220405 | A1 | 9/2008 | Lynch | |

FOREIGN PATENT DOCUMENTS

| | | | |
|---|---|---|---|
| CN | 2365084 | Y | 2/2000 |
| CN | 201342873 | Y | 11/2009 |
| WO | WO 0046042 | A1 | 8/2000 |

* cited by examiner

*Primary Examiner* — Shay Karls

(74) *Attorney, Agent, or Firm* — Gearhart Law, LLC

(57) ABSTRACT

A convenient way to erase a dry-erase writing board is described. One or more erasers are mounted to a shaft that travels along the surface of a dry-erase writing board. A motorized transport mechanism may be used to propel the shaft along the writing board. Other options include a remote control system, handles, a cleaning fluid dispensing system, and a marker holder.

20 Claims, 15 Drawing Sheets

DRY BOARD ERASER SYSTEM

CLAIM OF PRIORITY

This application claims priority to U.S. Provisional Patent No. 61/502,079 entitled "Dry Board Eraser System" filed on Jun. 28, 2011, the contents of which are fully incorporated herein by reference.

FIELD OF THE INVENTION

This invention relates generally to dry erase writing boards. More particularly, the present invention relates to an apparatus for erasing a dry erase writing board.

BACKGROUND

Dry markers have been in use for many years to mark on white (dry erase) boards with several different colors of marker. Large hand-held felt erasers of a size similar to conventional chalkboard erasers are commonly supplied for use with dry markers in cleaning the dry markings off of the white board after it has been marked up to clear the white board for another set of markings. Erasing with such an eraser can be a manually intensive and time-consuming process, and the erasers can be easily lost. Therefore, it is desirable to have an improved dry erase board eraser system.

SUMMARY

Embodiments of the present invention provide a convenient way to erase a dry-erase writing board. One or more erasers are mounted to a shaft that travels along the surface of a dry-erase writing board. In one embodiment, a motorized transport mechanism propels the shaft along the writing board. Other embodiments comprise a remote control system, handles, a cleaning fluid dispensing system, and a marker holder. While the examples disclosed in the following description include a dry-erase board, embodiments of the present invention may also be used with interactive white boards (e.g. "SMART boards") which also have an erasable property.

In one embodiment, an erasing system for erasing writing on a writing board is provided. The system comprises: a shaft; at least one eraser mounted to the shaft; a rail assembly mounted to a perimeter surface of the writing board; wherein the shaft is configured and disposed to travel along the rail assembly, whereby the at least one eraser is in contact with the writing surface, thereby erasing the writing surface.

In another embodiment of the present invention, an erasing system is provided, the system comprising: a shaft; at least one eraser mounted to said shaft; a rail assembly mounted to a perimeter surface of the writing board, the rail assembly comprising a motor and transport mechanism; wherein the shaft is configured and disposed to engage the transport mechanism.

DETAILED DESCRIPTION

Figure 1:
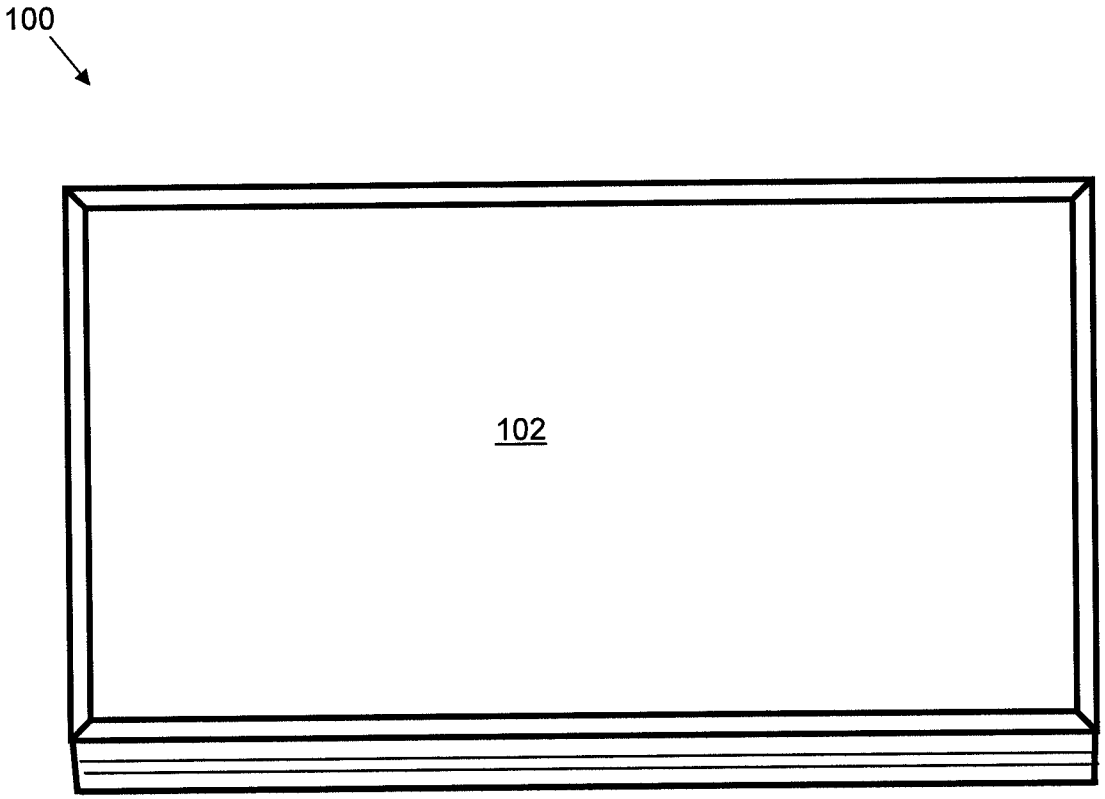
FIG. 1 is an existing dry erase board.

FIG. 1 shows an existing writable board 100, comprising writing surface 102. Writeable board 100 may be a "dry erase" type of writable board. As can be seen in the figure, the writable board has no integral device for erasing the writing surface. Erasers are stored in an attached tray or elsewhere. The erasers are easily lost, so the user may have to waste time looking for them, buy new ones, or substitute a poor replacement such as a paper towel, which may not erase the board completely. Additionally, only one or at most two erasers can be employed at a time by the user, prolonging the time it takes to erase the board.

The present invention solves the problems presented by existing writable boards by combining an eraser assembly with a writable board in an integral fashion, such that the erasers aren't separated from the writable board and are not easily lost. The eraser assembly contains multiple erasers, so that the entire board may be erased more quickly than with conventional boards. The multiple erasers may be selectively employed, so only a portion of the board may be erased, if desired.

Figure 2:
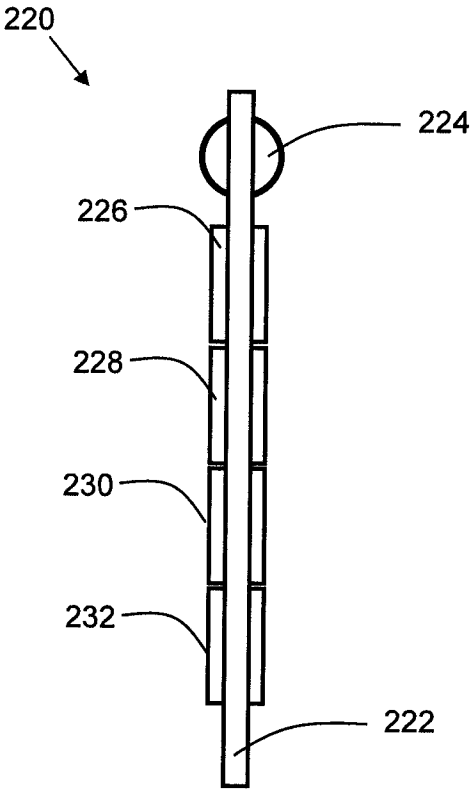
FIG. 2 is a front view of an apparatus in accordance with an embodiment of the present invention.

FIG. 2 is a front view of an eraser assembly 220 in accordance with an embodiment of the present invention. Eraser assembly 220 comprises a shaft 222 with a plurality of erasers, including first eraser 226, second eraser 228, third eraser 230, and fourth eraser 232 mounted to shaft 222. While FIG. 2 shows four erasers, it is possible to have more or fewer erasers without departing from the scope and purpose of the present invention. A wheel 224 is mounted at the upper end of shaft 222.

The erasers may be mounted to the eraser assembly in any fashion. It is preferable that the erasers be firmly mounted but also removable, in case they need to be replaced due to wear or damage. The erasers are rotatable around the shaft, so they may be secured to the shaft by systems including, but not limited to, hooks, rings, hinges, or other systems, wherein the erasers are attached to the securing systems by, but not limited to, gluing, having a slot mechanism, having a mechanism similar to hook and eye closures, or any other effective method for attaching the erasers to the securing systems. The erasers may also be magnetic, wherein at least two of the erasers are magnetic. They may have magnetic components or have magnets disposed inside them. In this case, the writing board and/or writing surface may also be magnetic, such that the erasers and the writing board and/or writing surface attract each other and the erasers are held more firmly against the writing board and/or writing surface due to magnetic attraction.

Figure 3:
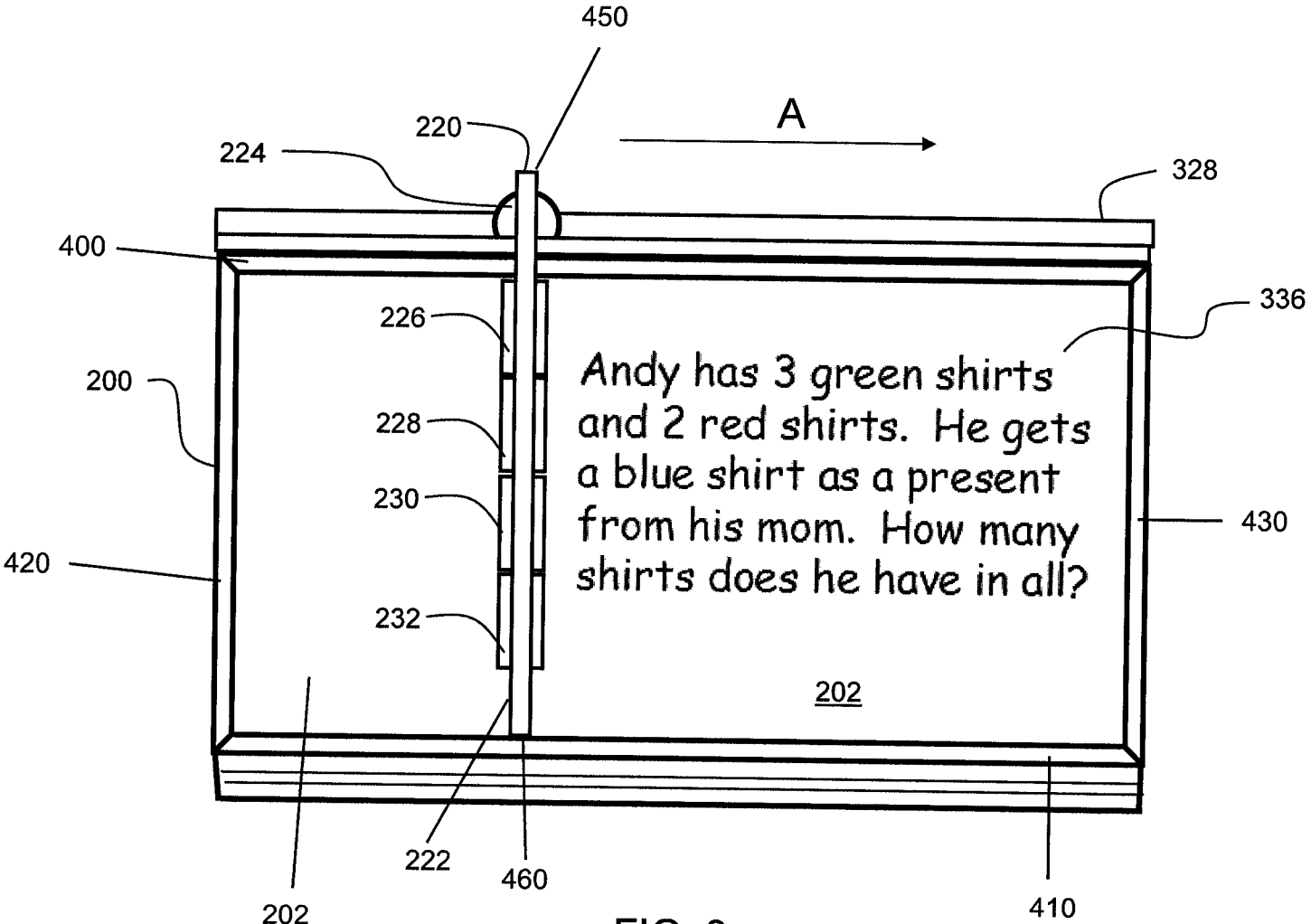
FIG. 3 is the apparatus of FIG. 2 installed on a dry erase board.

FIG. 3 shows eraser assembly 220 mounted on a writing board 200 via shaft 222. Writing board 200 has writing surface 202, which has writing 336 on it. Writing board 200 also has top perimeter 400, bottom perimeter 410, first side perimeter 420, and second side perimeter 430. Rail assembly 328 is mounted on the top perimeter 400 of writing board 200, although it may be mounted on bottom perimeter 410, on first side perimeter 420 or second side perimeter 430, or on any combination of these. There may be one rail assembly, or two, three, or four rail assemblies. Shaft 222 has shaft upper end 450 and shaft lower end 460. Shaft 222 is attached to wheel 224 at shaft upper end 450; it could be attached to the wheel at the shaft lower end 460 either individually or in tandem with attachment to shaft upper end 450. Alternately, the wheel and rail assembly may be attached to the bottom perimeter 410 and not to the top perimeter 400. Wheel 224 resides in rail assembly 328 and rides along rail assembly 328 in the direction indicated by arrow A, such that the erasers, including first eraser 226, second eraser 228, third eraser 230, and fourth eraser 232, are moved simultaneously across writing surface 202.

Figure 4:
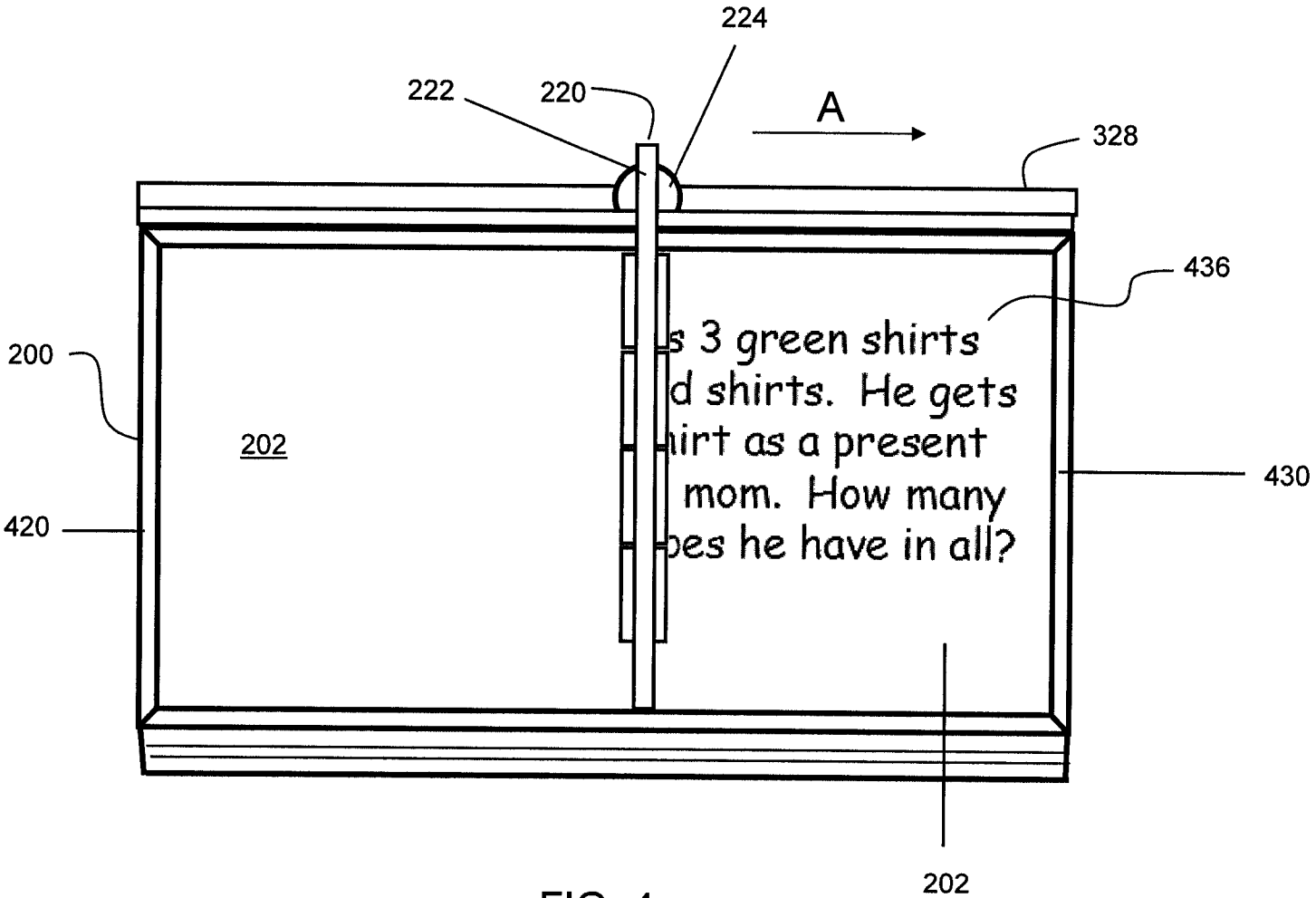
FIG. 4 illustrates the apparatus of FIG. 3 in use to erase writing.

FIG. 4 illustrates the apparatus of FIG. 3 in use to erase writing. FIG. 4 shows writing board 200 with writing surface 202, eraser assembly 220, rail assembly 328, and writing 436. Writing 436 is a partially erased version of writing 336 of FIG. 3. In FIG. 4, the user has activated the device either by grasping the shaft 222 and manually propelling the eraser assembly 220 across the writing surface 202, or by activating a motorized component (shown in FIG. 11) to propel the eraser assembly 220 across the writing surface 202. The wheel 224 rides along a groove in the rail assembly 328 and propels the eraser assembly 220 along with it from first side perimeter 420 to second side perimeter 430. Details of the mechanism are discussed in FIG. 7. Once the writing is erased, the eraser assembly can be left at second side perimeter 430 or can be propelled back to first side perimeter 420.

Figure 5:
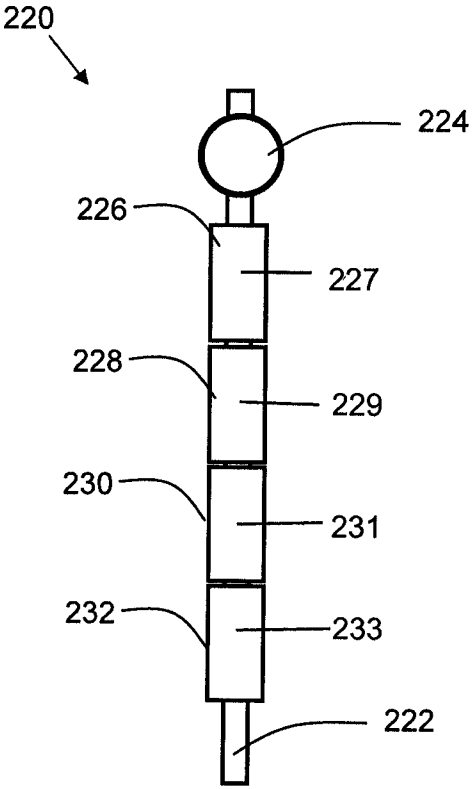
FIG. 5 shows a back view of the apparatus of FIG. 2.

FIG. 5 shows a back view of the apparatus of FIG. 2, indicating wheel 224, shaft 222, and erasers, including first eraser 226, second eraser 228, third eraser 230, and fourth eraser 232. The eraser faces are shown, including first eraser face 227, second eraser face 229, third eraser face 231, and fourth eraser face 233. When in use, the eraser faces contact the writing board shown in earlier figures. The eraser faces are preferably made from a soft absorbent material, such as but not limited to, felt or foam, or any suitable material, such that they can lift and/or absorb ink from the writing board.

Figure 6:
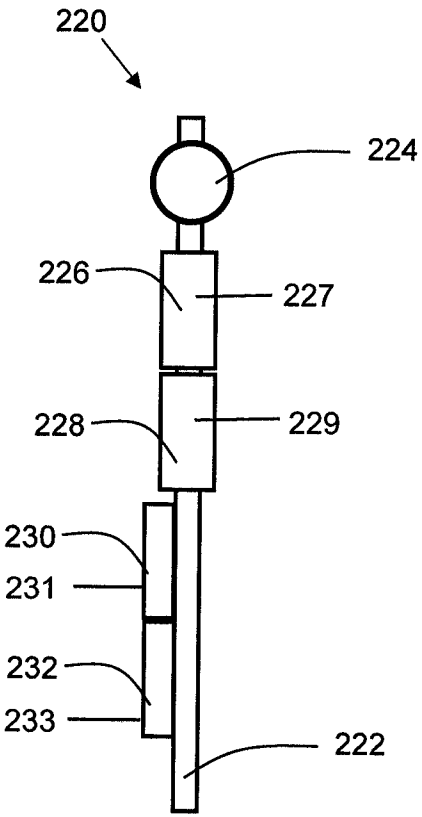
FIG. 6 shows a back view of an embodiment having rotatable erasers.

FIG. 6 shows a back view of an embodiment where each eraser is rotatable around shaft 222, showing eraser assembly 220 with shaft 222 and wheel 224. This allows a portion of the writing surface to be erased while the remainder is left intact as the shaft with eraser assembly traverses the writing board. FIG. 6 shows third eraser 230 and fourth eraser 232 rotated to a non-erasing position, such that third eraser face 231 and fourth eraser face 233 are not in a position to contact the writing board and writing board surface when the eraser assembly 220 is disposed on the writing board. First eraser 226 and second eraser 228 are in position so that the first eraser face 227 and second eraser face 229, will contact the writing board writing surface when the eraser assembly is disposed on the writing board. In this way, a portion of the writing board can be left un-erased. For example, with the configuration shown in FIG. 6, the upper portion of the writing board would be erased, but the lower portion of the writing board would not be erased, since third eraser 230 and fourth eraser 232 are rotated out of the way.

Figure 7:
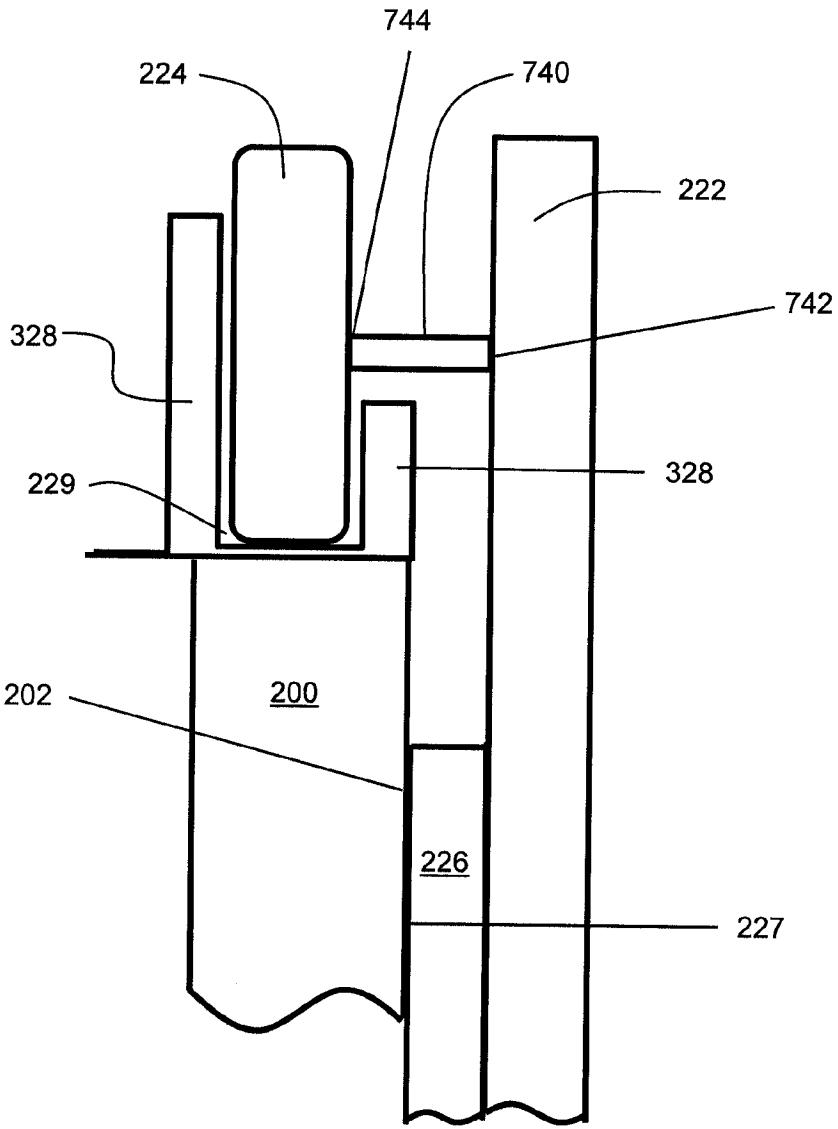
FIG. 7 shows a detailed view of the rail assembly for an embodiment of the present invention.

FIG. 7 shows a detailed view of the rail assembly for an embodiment of the present invention. Axle 740 is affixed to shaft 222 at first end 742, and to wheel 224 at second end 744. Wheel 224 is disposed within groove 229 of rail assembly 328. First eraser 226 and first eraser face 227 are disposed against writing board 200 and writing surface 202 by shaft 222, such that writing on writing board 200 is erased when shaft 222 is moved along writing board 200. As can be seen in this figure, when the shaft 222 is moved, either manually or electronically, the axle 740 turns the wheel 224, and the eraser assembly (of which only the first eraser 226 is shown) is propelled along the writing surface 202 of the writing board 200. The wheel 224 is disposed in the groove 229 of the rail assembly 328; as shown in FIG. 3, the rail assembly 328 traverses the length of the writing board 200, as does the groove 229, so the entire length of the writing surface 202 may be erased.

Figure 8:
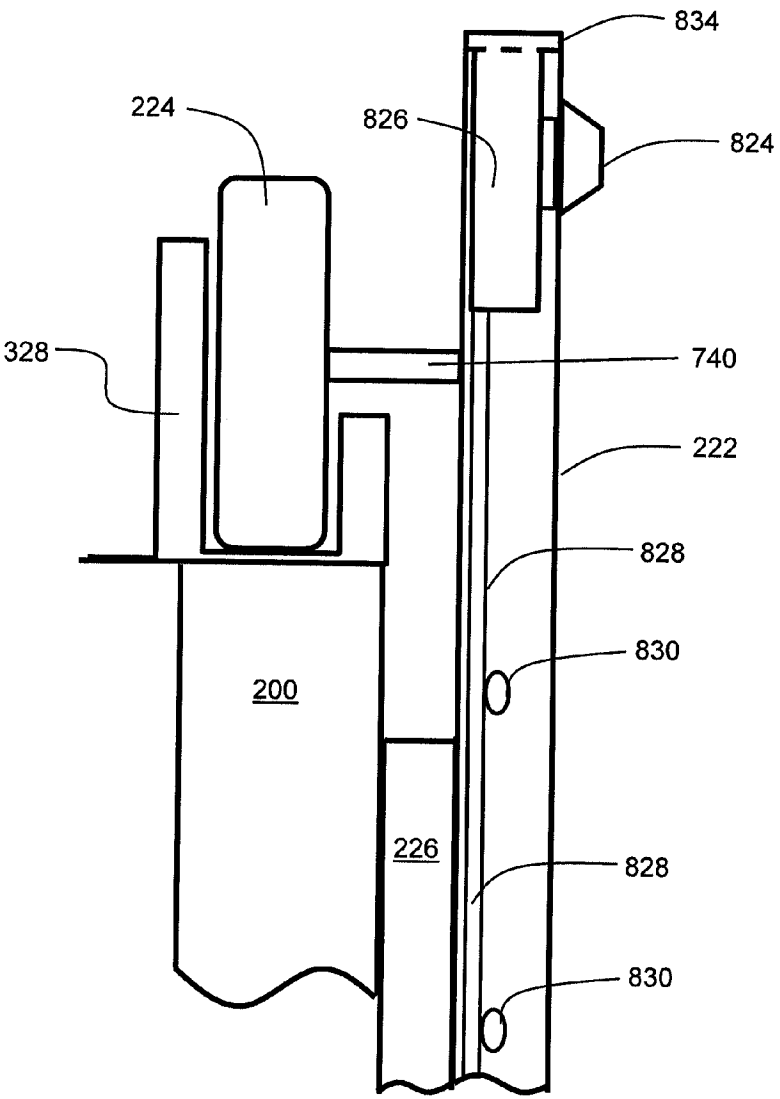
FIG. 8 shows a detailed side view of an additional embodiment of the present invention comprising a fluid dispensing system.
Figure 9:
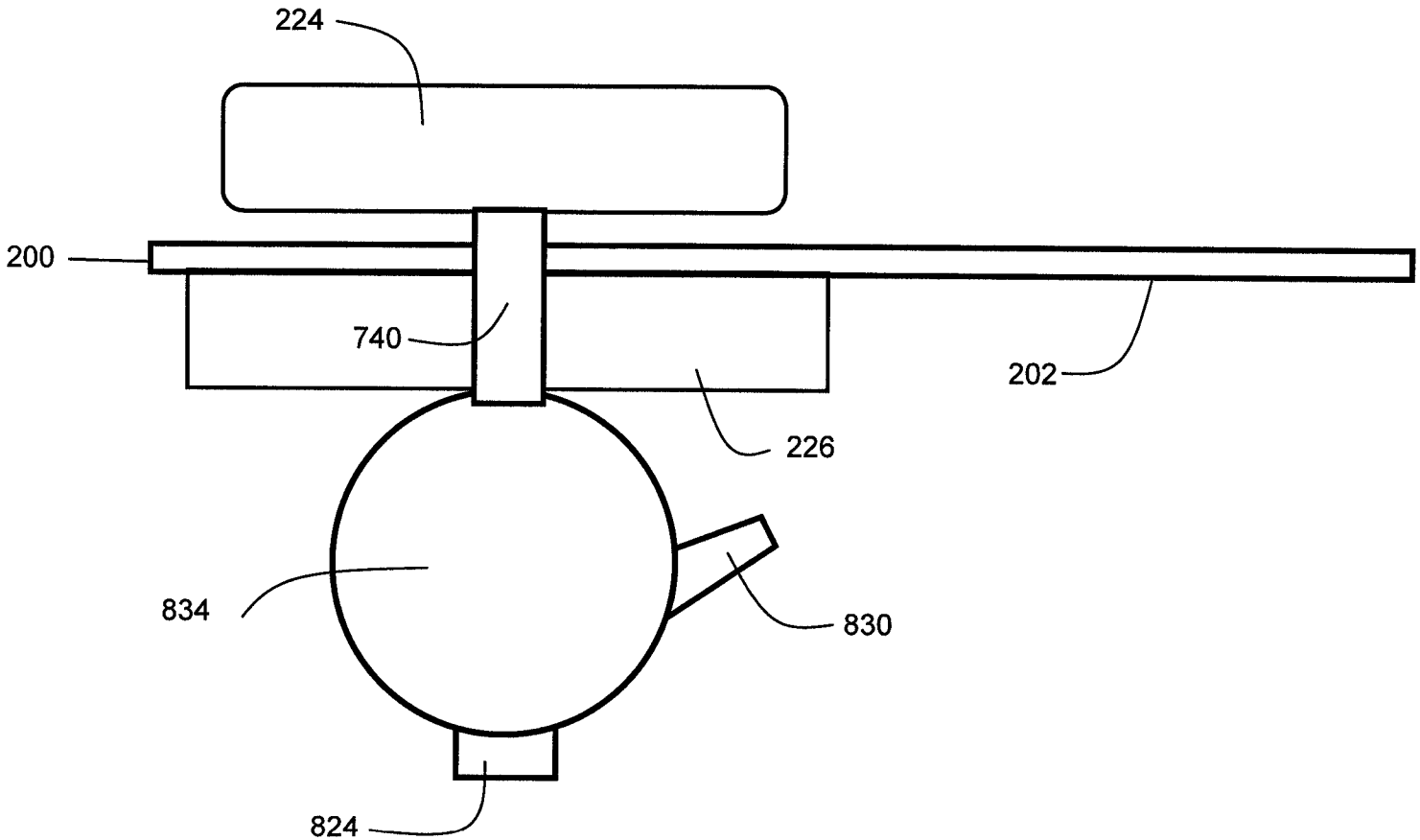
FIG. 9 shows a top down view of the embodiment of FIG. 8.
Figure 10:
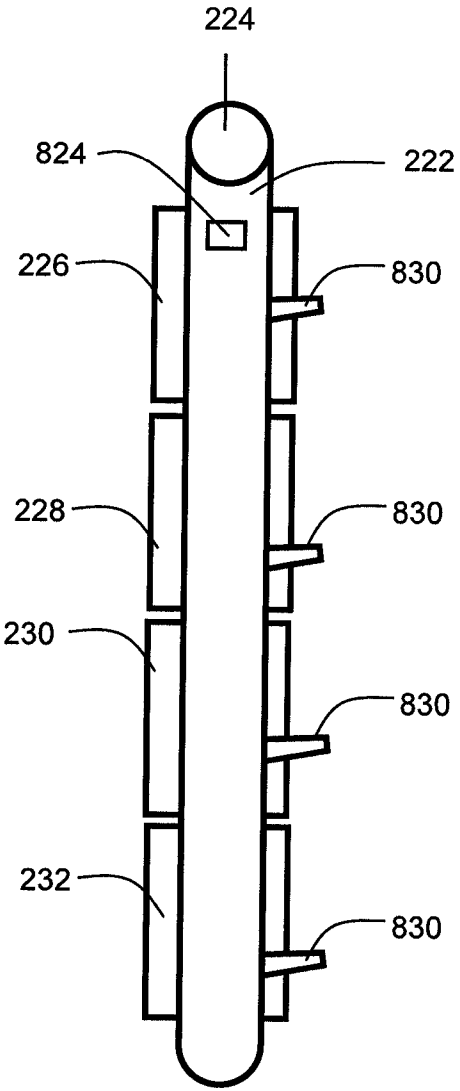
FIG. 10 shows a front view of the embodiment of FIG. 9.

FIGS. 8-10 show details of an additional embodiment of the present invention comprising a fluid dispensing system.

FIG. 8 shows a detailed side view of an additional embodiment of the present invention comprising a fluid dispensing system. Shown in FIG. 8 is the writing board 200, with wheel 224, first eraser 226, and rail assembly 328. Also shown is the axle 740 joining the wheel 224 and the shaft 222. FIG. 8 shows shaft 222 with a dispenser control 824, a fluid reservoir 826, a conduit 828, nozzles 830, and a removable cap 834. A fluid reservoir 826 is configured and disposed to contain liquid cleaning fluid. The fluid reservoir 826 is filled by opening removable cap 834 to expose an open top of the reservoir. Dispenser control 824 is configured and disposed such that, when pressed, it exerts pressure on the fluid reservoir 826, which dispenses fluid through conduit 828, and into a plurality of nozzles 830, where the fluid is then dispensed onto the writing board 200. This serves to provide further cleaning capabilities for stubborn marks, such as when dry erase marker is left for too long on a dry erase board. In one embodiment, the fluid reservoir has a capacity ranging from about 3 ounces to about 5 ounces.

FIG. 9 shows a top down view of the embodiment of FIG. 8. Shown in FIG. 9 is the writing board 200, with writing surface 202, wheel 224, and first eraser 226. Also shown is axle 740, dispenser control 824, a nozzle 830, and removable cap 834. In this view, it can be seen that nozzles 830 are directed towards writing surface 202, such that when cleaning fluid is dispensed by depressing dispenser control 824, the cleaning fluid is applied to writing surface 202.

FIG. 10 shows a front view of the embodiment of FIG. 9. Shown in FIG. 10 is the shaft 222, with wheel 224, first eraser 226, second eraser 228, third eraser 230, fourth eraser 232, dispenser control 824, and nozzles 830. FIG. 10 shows a plurality of nozzles 830 disposed on shaft 822. In FIG. 10, there is a nozzle aligned with each eraser, but there could be any number of nozzles in any configuration, and the nozzles can be any shape. The nozzles are preferably disposed on the shaft such that they spray liquid onto a portion of the writing surface before the erasers traverse that portion as the writing board is being erased.

Although FIGS. 8-10 show the nozzles disposed on the shaft, the nozzles may be disposed anywhere on the device, including on the writing board top perimeter, lower perimeter, first side perimeter, second side perimeter, or any combination of these, either with each other and/or with the embodiment shown in FIGS. 8-10.

Figure 11:
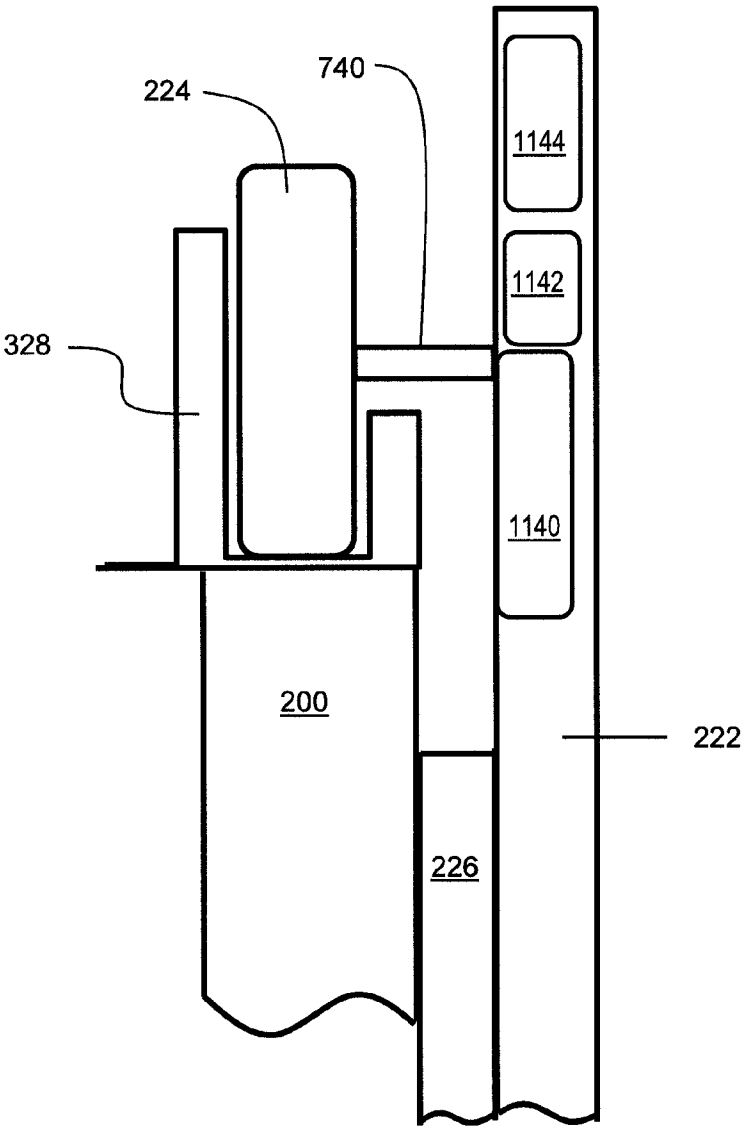
FIG. 11 shows a detailed side view of an additional embodiment of the present invention comprising a motorized transport system.

FIG. 11 shows a detailed side view of an additional embodiment of the present invention comprising a motorized transport system. Shown in FIG. 11 is writing board 200, shaft 222, wheel 224, eraser 226, rail assembly 328, axle 740, motor 1140, controller 1142, and power source 1144. In this embodiment, motor 1140 drives wheel 224 via axle 740. Optionally, controller 1142 is configured and disposed to control motor 1140 via a remote control. In one embodiment, a wireless RF, or infrared transmitter is used to signal controller 1142 from a distance. Power source 1144, such as but not limited to, a battery may be used to provide power to the controller 1142 and motor 1140. In one embodiment, the power source 1144 comprises a rechargeable battery. The motor may be configured to propel the shaft in either or both directions across the writing board, from first side perimeter to second side perimeter (shown in FIG. 3) from second side perimeter to first side perimeter, or in both directions.

Figure 12:
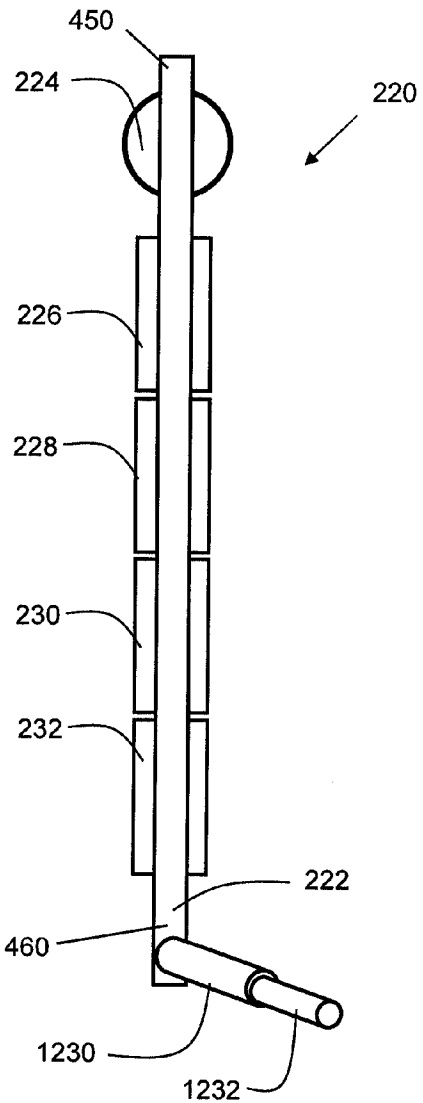
FIG. 12 shows a front view of an additional embodiment of the present invention comprising a collapsible handle.

FIG. 12 shows a front view of an additional embodiment of eraser assembly 220. This embodiment includes a handle 1230. Shown in FIG. 12 is shaft 222, wheel 224, first eraser 226, second eraser 228, third eraser 230, fourth eraser 232, shaft upper end 450, shaft lower end 460, handle 1230, and handle extension 1232. Handle 1230 is affixed to the shaft lower end 460. A handle extension 1232 extends from handle 1230, allowing the handle extension 1232 to be stowed when not in use. The handle 1230 allows a user to hand crank the shaft in order to move it across the writing board. It is placed at the shaft lower end to allow wheelchair access to the eraser assembly 1220. It could be placed anywhere on the shaft, for instance at or near the shaft upper end 450, or in the middle of the shaft. Although shown as a bar type of handle, it could be any type or shape, including but not limited to, a round handle.

Figure 13:
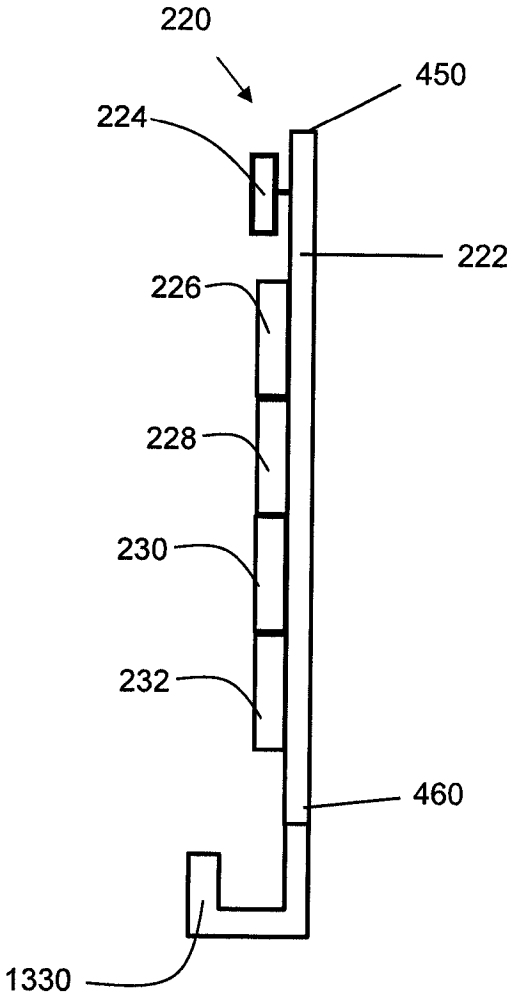
FIG. 13 shows a side view of an additional embodiment of the present invention comprising a U-shaped handle.

FIG. 13 shows a side view of an additional embodiment of the present invention comprising a U-shaped handle. Shown in FIG. 13 are eraser assembly 220, shaft 222, wheel 224, first eraser 226, second eraser 228, third eraser 230, fourth eraser 232, shaft upper end 450, shaft lower end 460, and U-shaped handle 1330. The U-shaped handle 1330 is affixed to the shaft lower end 460, either permanently or removably. The handle would be placed such that the U-shape was below the writing board bottom perimeter so it could be easily turned without hitting the board.

Figure 14:
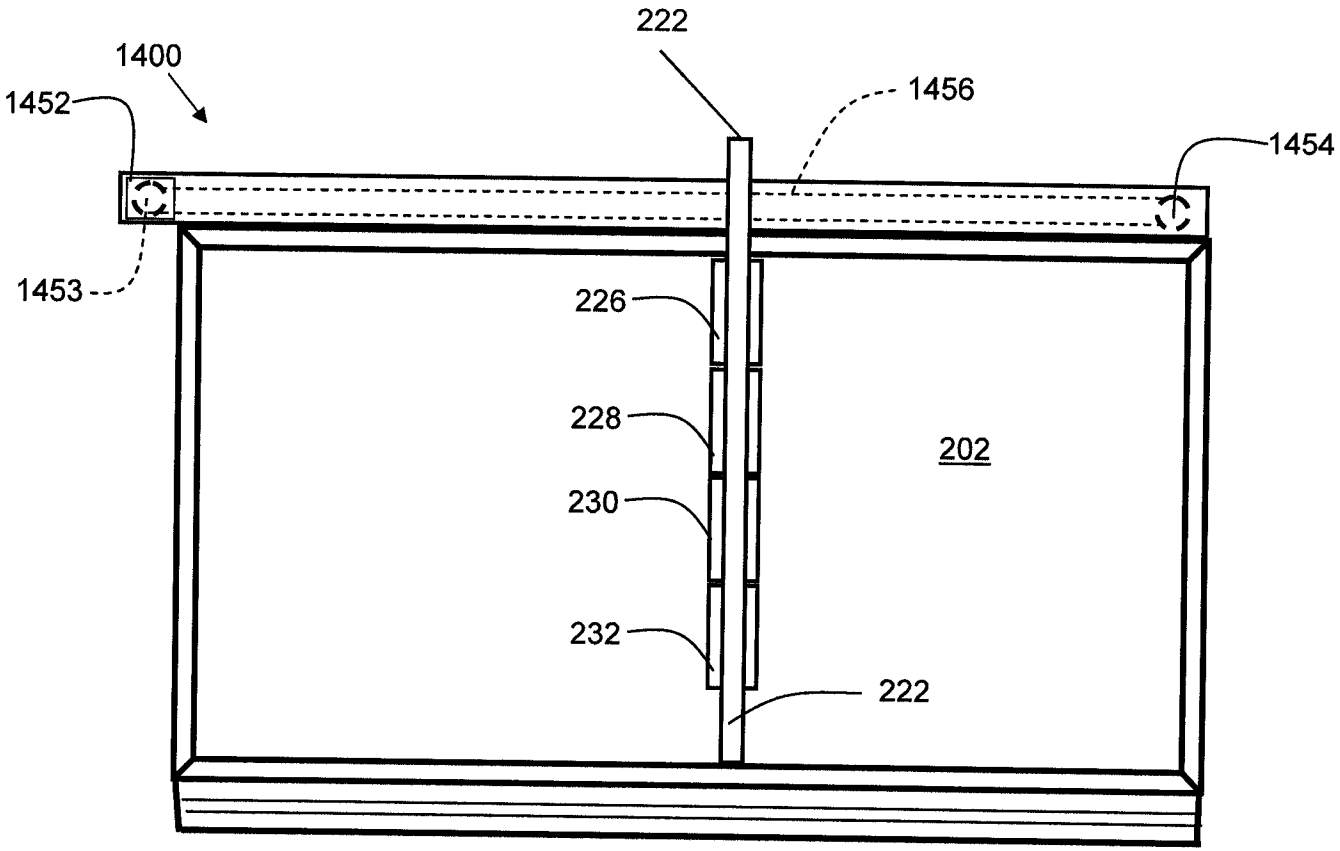
FIG. 14 shows a front view of an additional embodiment of the present invention comprising a motorized rail assembly.

FIG. 14 shows a front view of an additional embodiment of an erasing system comprising a motorized rail assembly 1400. Motorized rail assembly 1400 comprises a motor 1452 having a motor pulley 1453, and a return pulley 1454. A drive belt 1456 is disposed around the motor pulley 1453 and return pulley 1454. The shaft 222 of the erasing system is mechanically linked to the drive belt 1456, such that when the motor 1452 moves the drive belt 1456, the shaft 222 moves, and moves erasers, including first eraser 226, second eraser 228, third eraser 230, and fourth eraser 232 across writing surface 202 to erase writing on writing surface 202.

Figure 15:
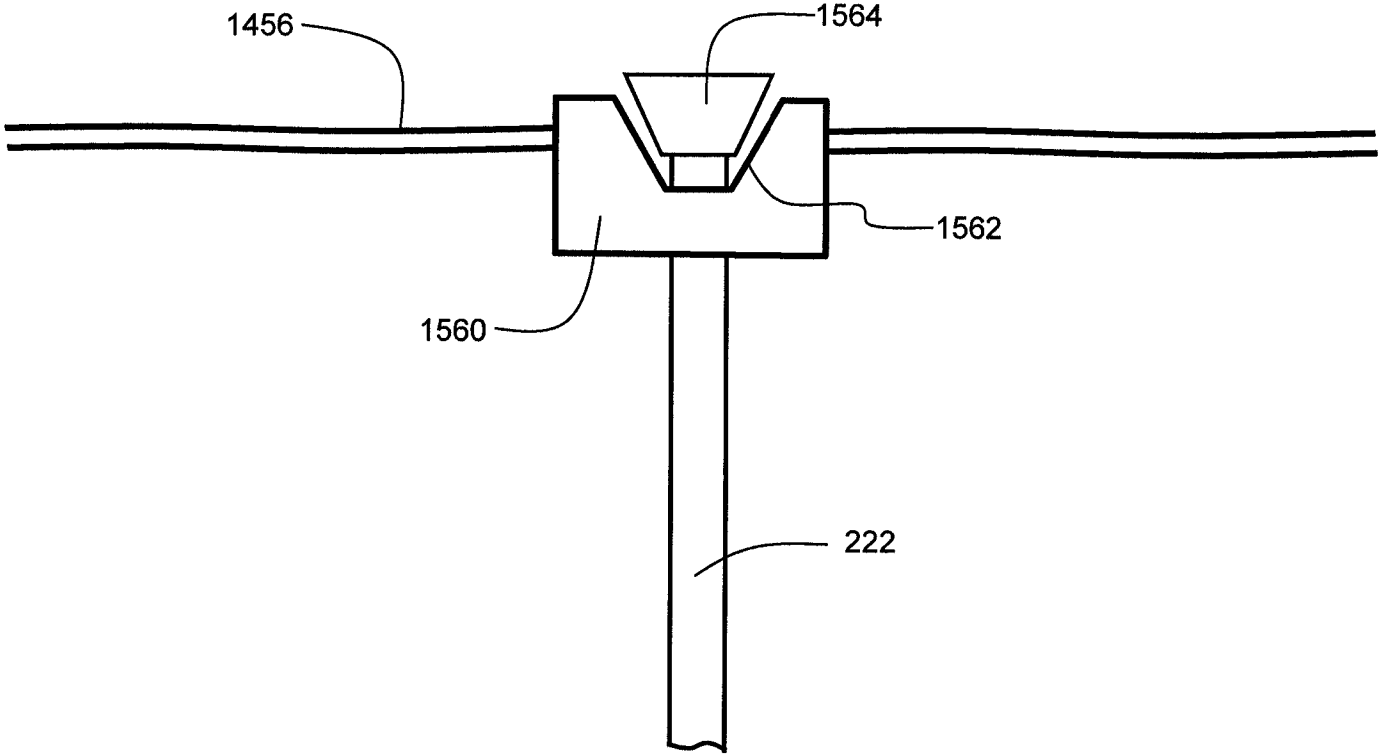
FIG. 15 is a detailed view of the transport mechanism for the motorized rail assembly.

FIG. 15 is a detailed view of an embodiment of the transport mechanism for the motorized rail assembly 1400 of FIG. 14. Chuck 1560 is attached to belt 1456. Chuck 1560 comprises receptacle 1562. Shaft 222 has protrusion 1564 affixed to the upper portion of shaft 222. Protrusion 1564 fits into receptacle 1562 of chuck 1560, thereby providing a mechanical linkage from the belt 1456 to the shaft 222.

Figure 16:
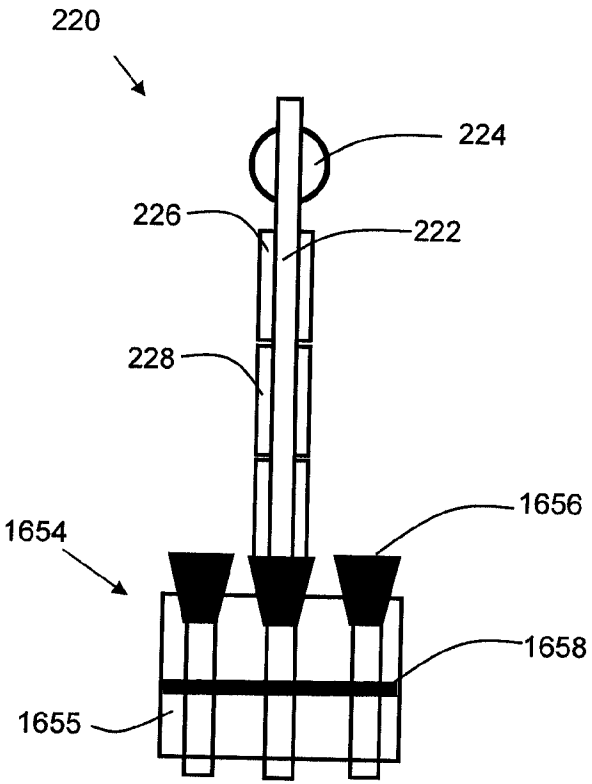
FIG. 16 shows a front view of an embodiment comprising a marker holder.

FIG. 16 shows a front view of an embodiment of an erasing system 220 comprising a marker holder 1654. Marker holder 1654 comprises a planar portion 1655 which is affixed to shaft 222. An elastic band 1658 is attached to planar portion 1655 at each end, and is disposed to hold a plurality of markers (indicated generally as 1656) against the planar portion 1655. In this way, the markers are conveniently available with the erasing system 1620.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An erasing system for erasing writing on a writing board comprising a writing surface, the erasing system comprising:

a shaft having a top end and a bottom end;

at least one independently rotatable eraser mounted to the shaft, wherein the at least one eraser is rotatable around a vertical axis;

a rail assembly mounted to a perimeter surface of the writing board;

an extendable handle located at the bottom end of the shaft, wherein a handle extension is slidably coupled to the extendable handle; and wherein the shaft is configured and disposed to travel along the rail assembly, whereby the at least one independently rotatable eraser is in contact with the writing surface, thereby erasing the writing surface.

2. The system of claim 1, further comprising a marker holder affixed to the shaft.

3. The system of claim 2, wherein the rail assembly comprises a groove, and wherein a wheel is mounted to the top end of the shaft, and wherein the wheel is disposed within the groove.

4. The system of claim 1, wherein there are four erasers with each of the four erasers mounted to the shaft.

5. The system of claim 4, wherein at least two of the erasers are magnetic.

6. The system of claim 1, further comprising a dispensing system for dispensing a fluid.

7. The system of claim 6, wherein the dispensing system comprises a fluid reservoir disposed within the shaft.

8. The system of claim 7, wherein the dispensing system comprises a plurality of nozzles located along the shaft, and oriented such that dispensed fluid is dispensed towards the writing surface.

9. The system of claim 8, wherein the fluid reservoir has a capacity ranging from about 3 ounces to about 5 ounces.

10. The system of claim 1, further comprising a motor, the motor configured and disposed to move the shaft across the writing surface.

11. The system of claim 10, wherein the motor is disposed within the shaft.

12. The system of claim 1, wherein the handle is U-shaped.

13. An erasing system for erasing writing on a writing board comprising a writing surface, the system comprising:

a shaft, the shaft comprising a top end and a bottom end;

at least one eraser mounted to the shaft, wherein the at least one eraser is independently rotatable about a vertical axis;

a rail assembly mounted to a top perimeter surface of the writing board, the rail assembly comprising a motor, an axle, a wheel, and a transport mechanism, wherein the axle extends perpendicularly from the shaft and is rotatably coupled to the wheel wherein the shaft is configured and disposed to engage the transport mechanism, and wherein the motor is configured to propel the shaft via the transport mechanism horizontally in either direction or both directions across the writing board.

14. The system of claim 13, further comprising a dispensing system for dispensing a fluid.

15. The system of claim 14, wherein the dispensing system comprises a fluid reservoir disposed within the shaft.

16. The system of claim 15, wherein the dispensing system comprises a plurality of nozzles located along the shaft, and oriented such that dispensed fluid is dispensed towards the writing surface.

17. An erasing system for erasing writing on a writing board comprising a writing surface, the erasing system comprising:

a shaft;

a plurality of erasers mounted to the shaft, wherein each of the plurality of erasers are independently rotatable around a vertical axis, such that it can be positioned in a non-erasing position;

a marker holder affixed to the shaft;

a rail assembly mounted to a top perimeter surface of the writing board, the rail assembly comprising a motor and a transport mechanism, wherein the transport mechanism comprises, a motor at a first end of the rail assembly, the motor comprising a motor pulley;

a return pulley at a second end of the rail assembly;

a belt disposed around the motor pulley and the return pulley;

a chuck attached to the belt, the chuck having a receptacle;

a protrusion, the protrusion mechanically linked to the shaft, and wherein the protrusion is configured and disposed to engage the receptacle.

18. The system of claim 17 wherein the motor is configured to propel the shaft horizontally in either direction or both directions across the writing board.

19. The system of claim 17 further comprising an extendable handle located at the bottom end of the shaft, wherein a handle extension is slidably coupled to the extendable handle and wherein the extendable handle provides for manual movement of the shaft across the writing board.

20. An erasing system for erasing writing on a writing board comprising a writing surface, the erasing system comprising:

a shaft having a top end and a bottom end;

at least one independently rotatable eraser mounted to the shaft, wherein the at least one eraser is rotatable around a vertical axis thereby enabling the at least one independently rotatable eraser to be positioned in a non-erasing position thereby enabling the system to erase the writing board wholly or in part along the length of the shaft;

a rail assembly mounted to a perimeter surface of the writing board; and wherein the shaft is configured and disposed to travel along the rail assembly, whereby at least one independently rotatable eraser is in contact with the writing surface, thereby erasing the writing surface.

* * * * *